US005197505A

United States Patent [19]

Tate

[11] Patent Number: 5,197,505

[45] Date of Patent: Mar. 30, 1993

[54] TENTS

[76] Inventor: Aarn Tate, 24 Rowan Lane, Woodley Park, Skelmersdale, Lancashire, WN8 6UL, United Kingdom

[21] Appl. No.: 611,254

[22] Filed: Nov. 9, 1990

[30] Foreign Application Priority Data

Nov. 11, 1989 [GB] United Kingdom ..... 8925555

[51] Int. Cl.[5] ..... E04H 15/36

[52] U.S. Cl. ..... 135/102; 135/104; 135/120

[58] Field of Search ..... 135/102, 104, 120, 97, 135/114

[56] References Cited

U.S. PATENT DOCUMENTS

| | | | |
|---|---|---|---|
| 607,933 | 7/1898 | Laird | 135/104 |
| 2,693,195 | 11/1954 | Frieder et al. | 135/102 |
| 2,930,387 | 3/1960 | Streich et al. | 135/102 |
| 3,699,987 | 10/1972 | Huddle | 135/97 X |
| 4,036,244 | 7/1977 | Huddle | 135/97 X |
| 4,719,934 | 1/1988 | Mydans | 135/104 X |
| 4,745,936 | 5/1988 | Scherer | 135/104 |
| 4,941,422 | 7/1990 | Muller | 135/104 X |

FOREIGN PATENT DOCUMENTS

| | | | |
|---|---|---|---|
| 1159914 | 7/1958 | France | 135/97 |
| 284530 | 1/1965 | Netherlands | 135/102 |
| 760960 | 11/1956 | United Kingdom | 135/104 |

*Primary Examiner*—David A. Scherbel
*Assistant Examiner*—Lan Mai
*Attorney, Agent, or Firm*—Maksymonko & Slater

[57] ABSTRACT

A tent comprises a fabric layer over one or more arch poles, wherein said pole or poles is tensionable by means of tensioning members connected between upper and lower points of each said pole.

9 Claims, 1 Drawing Sheet

TENTS

DESCRIPTION

This invention concerns tents.

There are two basic tent shapes both of which are aerodynamically efficient, namely tunnel and dome-shaped tents. These tent shapes were developed when high tensile aluminium alloy tent poles able to form arches were introduced. While these poles allow the creation of aerodynamic shapes, their flexibility means that they distort in strong winds, causing the tent to lose its initial aerodynamic shape. To overcome this distortion tent manufacturers increased the number of poles and criss-crossed them to create complex geodesic shapes. Such tents are stable in strong winds but are heavy to carry, expensive and more difficult to pitch.

An object of this invention is to provide means for providing stability to tents of the type having arched poles.

According to the invention there is provided a tent comprising a fabric layer over one or more arch poles, wherein said pole or poles is or are tensionable by means of tensioning members connected between upper and lower points of each said pole, whereby distortion of pole shape is resistable.

Each pole is preferably in a sleeve of said fabric layer and each tensioning means is preferably attached to a said sleeve at each end.

Preferably two tensioning members are provided both attached at an apex of the tent at one end and each to an opposite side of the tent at the other end at or near ground level.

In one preferred embodiment the tensioning members are fabric straps of adjustable length, although extent of adjustment is preferably limited to avoid over-tensioning. In another preferred embodiment the tensioning members are poles, typically of a high tensile aluminium alloy. The latter tensioning poles are preferably only used in combination with a tensioning membrane that forms an internal partition of the tent.

This invention will now be further described, by way of example only, with reference to the accompanying drawings, in which.

Referring to FIGS. 1 to 4 of the accompanying drawings, there are two basic tent shapes both of which are aerodynamically efficient namely tunnel (FIGS. 1 to 3) and dome (FIG. 4) shapes. Each tent 10 comprises an outer fabric layer 12 stretched over poles 14 of, for example high tensile aluminium alloy retained in sleeves of the outer fabric layers. The poles 14 are in the form of arches and are made up of spring-linked sections joined end to end.

Figure 1:
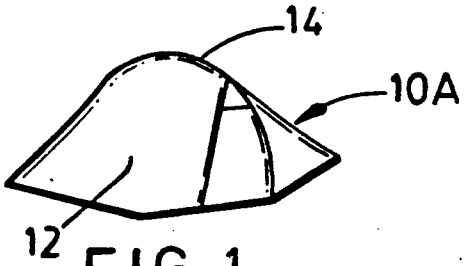
FIGS. 1 to 4 show various tent designs of the type to which the invention may be applied.
Figure 2:
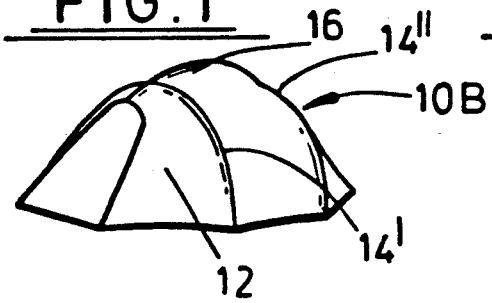

In FIG. 1 a single pole tunnel tent 10A is shown. In FIG. 2 a 2½ pole ridge tunnel tent 10B is shown. In that tent there are two spaced parallel arch poles 14', 14" and a half length pole 16 transverse to the arch poles between the front and rear of the tent.

Figure 3:
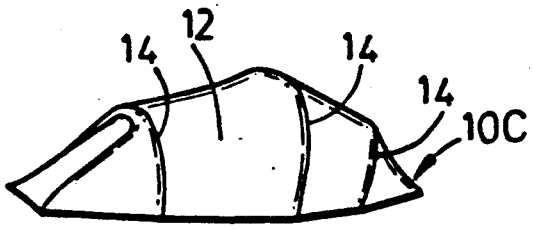
Figure 4:
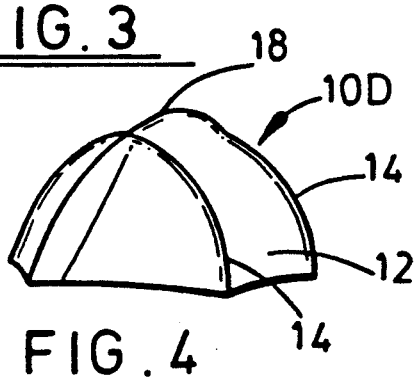

In FIG. 3 there is shown a three pole tunnel tent 10C and in FIG. 4 a three pole dome tent 10D, in which two poles 14', 14" are arranged parallel to each other and the third pole 18 is transverse thereto.

Figure 5:
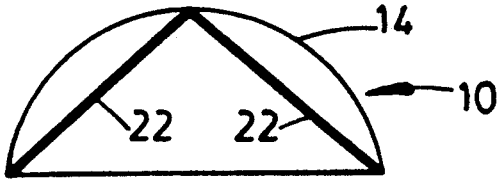
FIG. 5 is a section through a tent using tensioning means of the invention.
Figure 6:
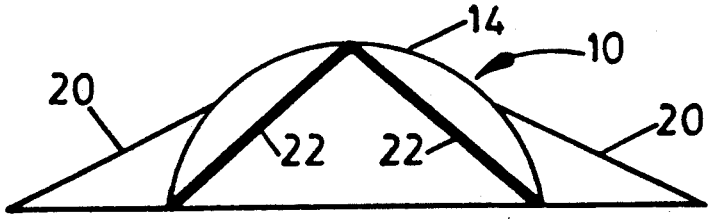
FIG. 6 is a section through a tent having external guys and using tensioning means of the invention.

In each of the above examples of tents, (and it will be appreciated that there will be other designs and shapes of tent to which the invention may be applied) any pole that spans a sleeping space may be tensioned as shown in FIGS. 5 and 6. (The difference between the tents of FIGS. 5 and 6 is that the latter has external guy ropes 20 for added security). In those Figures two straps 22 are connected to the apex of the tent typically to the pole sleeve at one end and each again typically to a pole sleeve at opposite sides of the tent at or near ground level. The straps 22 are of suitably strong fabric and include means for adjusting their length so as to enable adjustment of their tension, and a stop to prevent over-tensioning.

The tensioning straps may not always be required, such as under mild weather conditions, and so clips (not shown) may be provided on the tent pole sleeves at intermediate points whereby a loosened tensioning strap may be fastened out of the way.

The tensioning straps are able to reduce pole distortion under the force of wind against a side of the tent. Thus, the poles will be able to withstand greater wind forces upon them without breaking.

Figure 7:
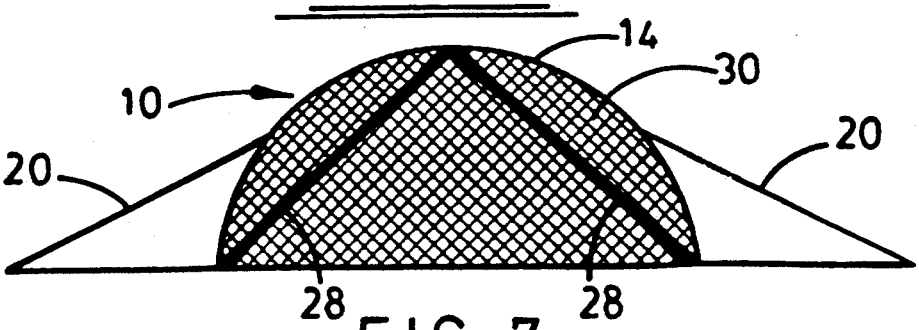
FIG. 7 is a section through a tent using poles as tensioning means.

Firstly, in FIG. 7 of the accompanying drawings, instead of tensioning straps, tensioning poles 28 are used also, for example of high tensile aluminium alloy to brace the tent poles 14 in much the same way as the straps of FIGS. 5 and 6. These poles can also take compression forces—e.g. snow load on the roof of the tent. However, the tensioning strap system means often that only one strap 22 is under tension whilst the other is relaxed but the tensioning poles 28 will take both stretching and compressing strains to provide even greater rigidity and support for the tent pole 14. The poles 28 are preferably used as shown in combination with a tensioning membrane 30, which will also serve as an internal partition for the tent. The tensioning membrane 30 is stretched across the tent within the plane of poles 14 and 28 thereof and also provides support itself for the tent pole 14.

We claim:

1. A tent comprising a fabric layer over one or more flexible resilient poles having opposed pole ends, each pole being arched and defined within a respective generally vertical plane, the tent having a longitudinal axis generally perpendicular to the plane of at least one pole, each pole being oriented such that the pole ends define lower points and a region of the pole intermediate the pole ends defines an upper point; a pair of tensioning members connected to at least one of said poles, each tensioning member having opposed ends connected at one end to said upper point of the pole and at the other tensioning member end to one or the other of the lower points of the pole to be in the same plane as the pole whereby the tensioning member is positioned within the tent and distortion of pole shape laterally to the longitudinal axis of the tent is resisted.

2. A tent as claimed in claim 1, wherein each pole is in a sleeve of said fabric layer.

3. A tent as claimed in claim 2, wherein said tensioning members are attached at each end to a sleeve.

4. A tent as claimed in claim 1 wherein the tensioning members include means for adjusting their length.

5. A tent as claimed in claim 4, wherein said means for adjusting are arranged for limited length adjustment of the tensioning members.

6. A tent as claimed in claim 4, wherein said adjusting means is attachable to its tent side between said upper and lower points when not required.

7. A tent as claimed in claim 1, wherein the tensioning members are poles.

8. A tent as claimed in claim 7, wherein the tensioning poles are of high tensile aluminium alloy.

9. A tent as claimed in claim 7 wherein said tensioning poles are used in combination with a membrane stretched across the tent and attached around the interior thereof.

* * * * *